US007290554B2

(12) United States Patent
Koeneman et al.

(10) Patent No.: US 7,290,554 B2
(45) **Date of Patent: *Nov. 6, 2007**

(54) EMBEDDED MICROFLUIDIC CHECK-VALVE

(75) Inventors: Paul B. Koeneman, Palm Bay, FL (US); Terry M. Provo, Palm Bay, FL (US)

(73) Assignee: Harris Corporation, Melbourne, FL (US)

( * ) Notice: Subject to any disclaimer, the term of this patent is extended or adjusted under 35 U.S.C. 154(b) by 336 days.

This patent is subject to a terminal disclaimer.

(21) Appl. No.: 10/872,203

(22) Filed: Jun. 18, 2004

(65) Prior Publication Data

US 2005/0281696 A1 Dec. 22, 2005

(51) Int. Cl.
*F16K 15/04* (2006.01)

(52) U.S. Cl. ..... 137/15.18; 137/315.33; 137/533.11; 251/368

(58) Field of Classification Search ..... 137/15.18, 137/315.33, 533.11, 533.19, 829, 833; 251/368; 156/89.11; 417/413.3
See application file for complete search history.

(56) References Cited

U.S. PATENT DOCUMENTS

| | | | | |
|---|---|---|---|---|
| 3,882,895 | A * | 5/1975 | Glattli et al. | 137/533.11 |
| 4,286,622 | A * | 9/1981 | Ninomiya et al. | 137/533.11 |
| 4,911,616 | A * | 3/1990 | Laumann, Jr. | 417/413.3 |
| 6,554,591 | B1 | 4/2003 | Dai et al. | |
| 6,572,830 | B1 * | 6/2003 | Burdon et al. | 156/89.11 |
| 6,620,273 | B2 | 9/2003 | Dai et al. | |
| 6,921,253 | B2 * | 7/2005 | Shuler et al. | 417/413.3 |
| 7,032,608 | B2 * | 4/2006 | Koeneman et al. | 137/15.18 |
| 2005/0279412 | A1 * | 12/2005 | Koeneman et al. | 137/539 |

* cited by examiner

*Primary Examiner*—John Rivell
(74) *Attorney, Agent, or Firm*—Darby & Darby; Robert J. Bacco

(57) ABSTRACT

Embedded check-valve manufacturing assembly (100, 600) for subsequent firing and integration in a micro-fluidic system. The assembly can include a check-valve chamber (104, 604), an inlet port (106, 606) and an outlet port (108, 608) formed from at least one layer of an unfired low-temperature co-fired ceramic (LTCC) tape to form a substrate (102, 602). A plug (114, 614) is disposed within the check-valve chamber that is capable of withstanding the LTCC firing process without damage or distortion.

20 Claims, 5 Drawing Sheets

EMBEDDED MICROFLUIDIC CHECK-VALVE

BACKGROUND OF THE INVENTION

1. Statement of the Technical Field

The inventive arrangements relate generally to micro-fluidic devices and more particularly to structures and systems for preventing fluid backflow.

2. Description of the Related Art

Micro-fluidic systems have the potential to play an increasingly important role in many developing technology areas. For example, there has been an increasing interest in recent years in the use of fluid dielectrics for use in RF systems. Likewise, conductive fluids can have use in RF systems as well.

Another technological field where micro-fluidic systems are likely to play an increasingly important role is fuel cells. Fuel cells generate electricity and heat by electrochemically combining a gaseous fuel and an oxidant gas, via an ion-conducting electrolyte. The process produces waste water as a byproduct of the reaction. This waste water must be transported away from the reaction to be exhausted from the system by a fluid management sub-system.

Efforts are currently under way to create very small fuel cells, called microcells. It is anticipated that such microcells may eventually be adapted for use in many portable electronics applications. For example, such devices could be used for powering laptop computers and cell phones. Still, microcells present a number of design challenges that will need to be overcome before these devices can be practically implemented. For example, miniaturized electro-mechanical systems must be developed for controlling the fuel cell reaction, delivering fuel to the reactive components and disposing of water produced in the reaction. In this regard, innovations in fuel cell designs are beginning to look to silicon processing and other techniques from the fields of microelectronics and micro-systems engineering.

Glass ceramic substrates sintered at 500° C. to 1,100° C. are commonly referred to as low-temperature co-fired ceramics (LTCC). This class of materials has a number of advantages that makes it especially useful as substrates for RF systems. For example, low temperature 951 co-fire Green Tape™ from Dupont® is Au and Ag compatible, and it has a thermal coefficient of expansion (TCE) and relative strength that are suitable for many applications. The material is available in thicknesses ranging from 114 μm to 254 μm and is designed for use as an insulating layer in hybrid circuits, multi-chip modules, single chip packages, and ceramic printed wire boards, including RF circuit boards. Similar products are available from other manufacturers.

LTCC substrate systems commonly combine many thin layers of ceramic and conductors. The individual layers are typically formed from a ceramic/glass frit that can be held together with a binder and formed into a sheet. The sheet is usually delivered in a roll in an unfired or "green" state. Hence, the common reference to such material as "green tape". Conductors can be screened onto the layers of tape to form RF circuit elements antenna elements and transmission lines. Two or more layers of the same type of tape are then fired in an oven.

Many of the same characteristics that make LTCC an excellent choice for fabrication of microelectronic circuits also suggest its value for use in microfluidic applications. LTCC is mechanically stable at temperatures from below freezing to over 250° C., has known resistance to chemical attack from a wide range of fluids, produces no warpage during compression, and has superior properties of absorption as compared to other types of material. These factors, plus LTCC's proven suitability for manufacturing miniaturized RF circuits, make it a natural choice for manufacturing microfluidic systems including, but not limited to, fluid systems used in microcells.

Many of the applications for fuel cells and other types of fluid systems can require fluid control systems, and more particularly an ability to prevent backflow of fluids. Accordingly, check-valves that allow fluid to flow in only one direction are often needed in such systems. Conventional approaches to such check-valves can be implemented in micro-fluidic LTCC devices as discrete components added to the LTCC after firing. However, discrete components are typically mounted on the surface of the device and can create a higher profile. They also can tend to be less robust.

In the semiconductor area, there has been some development of micro electromechanical systems (MEMS) that include check-valves. However, these devices tend to have long development times, are difficult to interface in the macro world, and require more mechanical interfaces. In contrast, LTCC systems can involve a considerably shorter development time and are showing promise in the fuel cell area. Accordingly, integrated LTCC fluid flow components are important for the future of micro-fluidic systems for fuel cells and other technologies.

SUMMARY OF THE INVENTION

The invention concerns a method for integrating a check-valve in an LTCC based micro-fluidic system. The method can include forming from at least one layer of an unfired low-temperature co-fired ceramic (LTCC) tape, a check-valve chamber, an inlet port in fluid communication with the check-valve chamber, and at least one outlet port in fluid communication with the check-valve chamber. A plug formed of fired LTCC or other material capable of surviving the LTCC firing process is positioned within the check-valve chamber. Thereafter, one or more layers of the unfired LTCC tape can be fired together with the plug disposed in the check-valve chamber. Because the plug can is pre-fired, it will not adhere to the interior of the chamber. Ceramic powder can be disposed between the plug and the check-valve chamber surfaces prior to the firing step in order to further reduce the possibility that the plug will adhere to the chamber surfaces.

The method can also include the step of selecting a shape of the check-valve chamber and a position of the inlet port for automatically sealing the inlet port with the plug in the presence of a fluid backflow from the check-valve chamber toward the inlet port. The shape of the check-valve chamber can also be selected for automatically unsealing the plug from the inlet port in the presence of a fluid flow from the inlet port toward the check-valve chamber. For example, the check-valve chamber can be formed so as to have a tapered profile. The tapered profile can taper inwardly in a direction toward the inlet port. According to another aspect, the inlet port and the outlet port can be formed on mutually orthogonal surfaces of the check-valve chamber.

According to one embodiment, the method can include the step of forming the check-valve chamber with a plurality of the outlet ports. According to another aspect, the shape of the plug can be selected to be spherical. According to yet another aspect, the method can include the step of forming a valve seat for the inlet port, where the valve seat defines a sealing surface corresponding to at least a portion of the plug.

The plug can be positioned within the check-valve chamber exclusive of any structure to restrict the movement of the plug within the check-valve chamber. Alternatively, a range of movement of the plug can be constrained to prevent sealing of at least one outlet port. The constraining step can include forming a guide structure in the LTCC tape layers for guiding the plug within the check-valve chamber.

According to another aspect, the invention concerns an embedded check-valve manufacturing assembly for subsequent firing and integration in a micro-fluidic system. The assembly can include a check-valve chamber formed from at least one layer of an unfired low-temperature co-fired ceramic (LTCC) tape. The check-valve chamber can have an inlet port in fluid communication with the check-valve chamber and an outlet port in fluid communication with the check-valve chamber. Further, a plug formed of fired LTCC or any other compatible material capable of withstanding the LTCC firing process can be positioned within the check-valve chamber. A ceramic powder can optionally be disposed within the check-valve chamber. With the assembly thus formed, the plug and the unfired LTCC tape forming the check-valve chamber are ready be fired together to form a completed check-valve assembly without adhesion of the plug to any portion of the check-valve chamber.

According to one aspect the check-valve chamber can have a tapered profile arranged so that the tapered profile tapers inwardly in a direction toward the inlet port.

According to another aspect, the check-valve chamber can include a plurality of outlet ports. The plug forms a seal at the inlet port by lodging against a valve seat, thereby preventing fluid from flowing from the check-valve chamber to the inlet port when there is a back pressure. In this regard, the plug can have a shape in which at least a portion of the plug corresponds to the contour of the valve seat to form an effective seal. Likewise, the valve seat formed at the inlet port can define a sealing surface corresponding to at least a portion of the shape of the plug. A sphere shaped plug can be advantageous as it will form an effective seal regardless of plug orientation.

The check-valve chamber can provide an unrestricted range of movement for the plug within the check-valve chamber or can further include a guide surface formed of the LTCC tape for constraining the movement of the plug within the check-valve chamber.

DETAILED DESCRIPTION OF THE PREFERRED EMBODIMENTS

Figure 1:
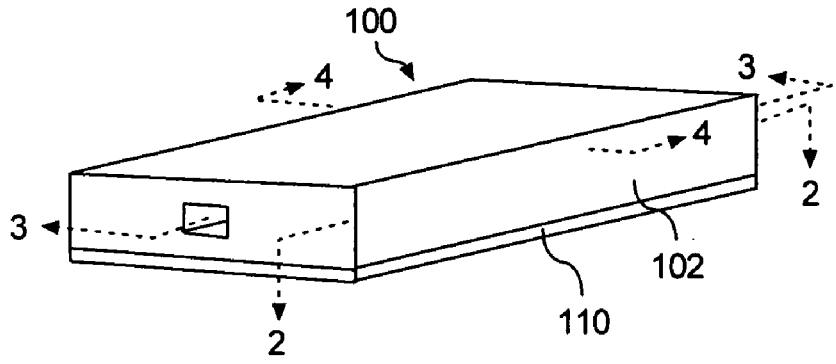
FIG. 1 is a perspective view of a micro-fluidic check-valve that is useful for understanding the present invention.

FIG. 1 shows a first embodiment of a check-valve assembly 100 that is implemented in a substrate 102. The check-valve assembly 100 can be a stand alone device or can be integrated with a larger system on the substrate. Examples of such systems can include fuel cells, micro-motors, and other MEMS type devices. Other examples can include fluid dielectric based devices in the RF field such as antenna elements, matching sections, delay lines, beam steering elements, tunable transmission lines, stubs and filters, variable attenuators, and cavity structures. Still, the invention is not limited to any particular type of device.

The substrate 102 can be formed of a ceramic material. Any of a wide variety of ceramics can be used for this purpose. However, according to a preferred embodiment, the substrate can be formed of a glass ceramic material fired at 500° C. to 1,100° C. Such materials are commonly referred to as low-temperature co-fired ceramics (LTCC).

Commercially available LTCC materials are commonly offered in thin sheets or tapes that can be stacked in multiple layers to create completed substrates. For example, low temperature 951 co-fire Green Tape™ from Dupont® may be used for this purpose. The 951 co-fire Green Tape™ is Au and Ag compatible, has acceptable mechanical properties with regard to thermal coefficient of expansion (TCE), and relative strength. It is available in thicknesses ranging from 114 μm to 254 μm. Other similar types of systems include a material known as CT2000 from W. C. Heraeus GmbH, and A6S type LTCC from Ferro Electronic Materials of Vista, Calif. Any of these materials, as well as a variety of other LTCC materials with varying electrical properties can be used.

In some instances it can also be desirable to include a conductive ground plane 110 on at least one side of the substrate 102. For example, the ground plane 110 can be used in those instances where RF circuitry is formed on the surface of the substrate 102. The conductive ground plane 110 can also be used for shielding components from exposure to RF and for a wide variety of other purposes. The conductive metal ground plane can be formed of a conductive metal that is compatible with the substrate 102. Still, those skilled in the art will appreciate that the ground plane is not required for the purposes of the invention.

Figure 2:
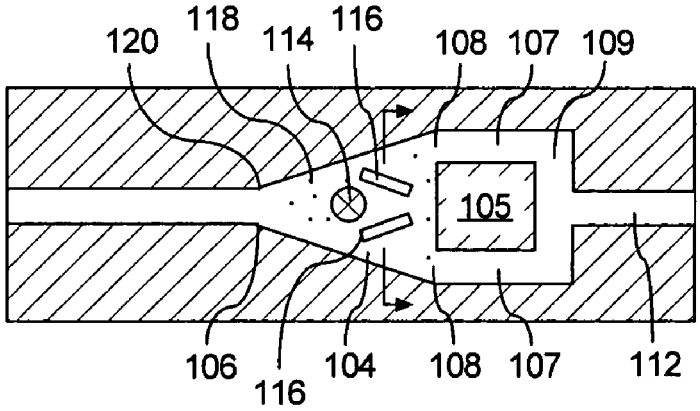
FIG. 2 is a cross-sectional view of the check-valve in FIG. 1, taken along line 2-2.
Figure 3:
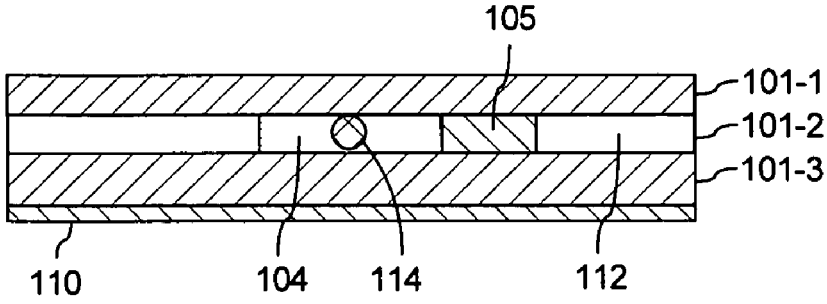
FIG. 3 is a cross-sectional view of the check-valve in FIG. 1, taken along line 3-3.

The check-valve assembly 100 is shown in cross-sectional view in FIGS. 2 and 3. As illustrated therein, a check-valve chamber 104 is formed from a plurality of layers 101-1, 101-2, 101-3 of unfired LTCC tape using conventional LTCC lamination techniques. In FIG. 3, only three layers of LTCC tape are shown. However, it should be understood that the invention is not limited in this regard and any number of LTCC tape layers can be used.

The check-valve chamber can have an inlet port 106 in fluid communication with the check-valve chamber 104 as shown. At least one outlet port 108 is also provided in fluid communication with the check-valve chamber 104. If more than one outlet port 108 is provided, a manifold 109 can provide multiple fluid paths 107 that advantageously allow both outlet ports 108 to feed a common output conduit 112. Consequently, if one outlet port 108 is blocked for any reason, fluid can continue flowing toward the outlet conduit 112 through the other outlet port.

The various internal structures, conduits and chambers shown in FIG. 2 can be formed by any suitable means. For example, after the layers 101-2 and 101-3 have been stacked, the internal structures such as island 105 and guide structures 116 can in one embodiment be hand placed within the check-valve chamber prior to adding the top layer 101-1. In another embodiment, the layers 101-2 and 101-3 could be laminated as shown, and could then be machined using a router so as to form the check-valve chamber, conduits, ports and other internal structures defining the check valve.

A plug 114 formed of fired LTCC can be positioned within the check-valve chamber 104 during the lay up process of the unfired LTCC tape. Alternatively, the plug can be formed of any other material capable of withstanding the LTCC firing process. For example, the plug could be made from aluminum oxide in one embodiment and zirconium oxide in a second embodiment. A plug formed from aluminum oxide is appropriate for use with Dupont 951 type LTCC whereas a plug formed from Zirconium oxide is well suited for use with Ferro A6 type LTCC.

The plug 114 is preferably formed so that it will be at least somewhat larger than the size of the opening defining the inlet port 106 after the LTCC tape layers forming the chamber have been fired. The plug 114 can advantageously be formed so as to have any shape that will allow the plug to form a close fitting seal when it is urged against the inlet port 106. For example, a spherical shape can be used for this purpose. The spherical shape will allow the plug, when it is urged toward the inlet port 106, to block the inlet port 106 regardless of the orientation of the plug. A spherically shaped plug 114 can be advantageous as it will form a proper seal regardless of plug orientation. Still, the plug can have other shapes and still form a suitable seal.

The inlet port 106 can also include a valve seat 120. The valve seat can define a contour or surface corresponding to at least a portion of the shape of the plug 114 for forming a good seal with the plug.

Figure 4:
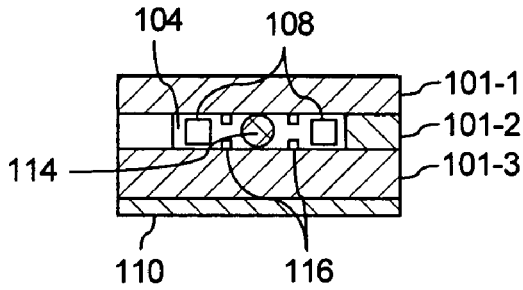
FIG. 4 is a cross-sectional view of the check-valve in FIG. 1, taken along line 4-4.

Referring now to FIG. 4, a guide structure 116 can optionally be provided within the check-valve chamber to constrain the motion of the plug 114. The guide structure 116 can perform several functions. For example, in those instances where a non-spherical shaped plug is used, the guide structure 116 can maintain the plug 114 in a desired orientation for forming a seal with the inlet port 106. The guide structure can also be used to limit a range of motion for the plug 114 so as to ensure that the plug cannot seal any of the outlet ports 108 when fluid is flowing in a forward direction, i.e. from the inlet port toward to outlet port. If the guide structure is used, in FIG. 2, the need for more than one outlet port can be avoided if there is no possibility that the outlet port will be blocked by the plug when fluid is flowing in the forward direction.

The plug can be formed in the required shape while the LTCC or other material from which it is formed is still in the unfired state. The plug can then be fired prior to being positioned within the check-valve chamber. Alternatively, the plug can be fired and then machined to the proper shape before being placed within the check valve chamber.

In either case, the plug 114 is advantageously fired prior to being positioned within the check-valve chamber. This pre-firing step ensures that the plug 114 will not adhere during the firing process to the surface of unfired LTCC tape layers 101-1, 101-2, 101-3 comprising the check-valve chamber 104. Once the pre-fired plug 114 and the layers of unfired LTCC tape 101-1, 101-2, 101-3 forming the check-valve chamber are assembled as shown, they are ready to be fired together to form a completed check-valve assembly.

As a further precaution to prevent adhesion of the plug 114 to the LTCC tape layers 101-1, 101-2, and 101-3 during a subsequent firing process, it can be advantageous to dispose a ceramic powder 118 within the check-valve chamber. In general, any ceramic powder can be used for this purpose provided that it can survive the LTCC firing profile and does not adhere to the LTCC. The specific powder would change for different LTCC material choices. For example, with Dupont 951 LTCC an aluminum oxide powder could be used. With Ferro A6 LTCC, zirconium oxide powder could be used. This is because Dupont 951 does not stick to aluminum oxide, and Ferro A6 does not stick to zirconium oxide. Ceramic powders such as those described herein are commercially available from a variety of sources including Sawyer Research Products, Inc. of 35400 Lakeland Boulevard, Eastlake, Ohio 44095, and Cotronics Corp. of 3379 Shore Parkway, Brooklyn, N.Y. 11235.

The check-valve chamber 104 can have a tapered profile so that it tapers inwardly in a direction of the inlet port 108. The tapered profile is useful for ensuring that the plug 114 will be directed toward the inlet port 106 in the event of a fluid backflow proceeding from the outlet ports 108 toward the inlet port 106. Still, those skilled in the art will appreciate that the check-valve chamber can have other shapes as well.

Figure 5A:
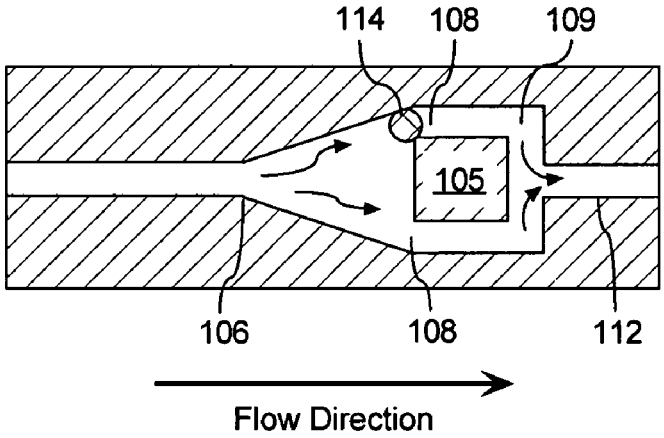
FIG. 5A is a cross-sectional view of the check-valve in FIG. 1, taken along line 2-2, in the presence of a fluid flow in a first direction.
Figure 5B:
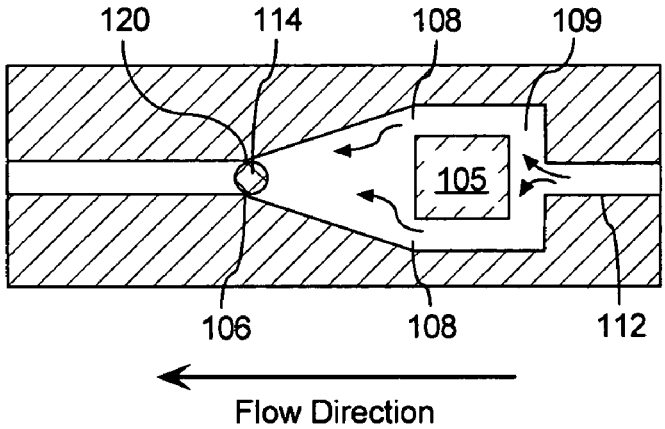
FIG. 5B is a cross-sectional view of the check-valve in FIG. 1, taken along line 2-2, in the presence of a fluid flow in a second back-flow direction.

Referring now to FIGS. 5A and 5B, it may be observed that fluid flow in a forward direction can cause the plug 114 to disengage from the valve seat 120. If a guide structure 116 is provided, the plug can be urged into the guide structure so as to remain clear of the outlet ports 108. Alternatively, if no guide structure 116 is provided, the plug 114 can move about freely in the chamber and may lodge in one of the outlet ports. Still, fluid will be able to flow freely in the forward direction since two outlet ports 108 are provided and the manifold 109 will direct a flow from either outlet port 108 to the outlet conduit 112.

The check-valve can prevent a fluid backflow as shown in FIG. 5B. In the event that conditions in a fluid system in which the check-valve is installed cause a fluid flow in the direction shown in FIG. 5B, the plug 114 will be urged toward the inlet port and will ultimately become lodged in the valve seat 120. Thereafter, backflow of fluid will be prevented and the plug 114 will not become unseated until a fluid flow in the direction shown in FIG. 5A is resumed.

Figure 6:
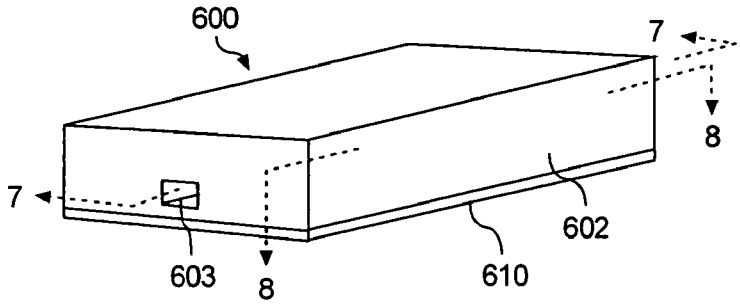
FIG. 6 is a perspective view of an alternative embodiment micro-fluidic check-valve that is useful for understanding the present invention.
Figure 7A:
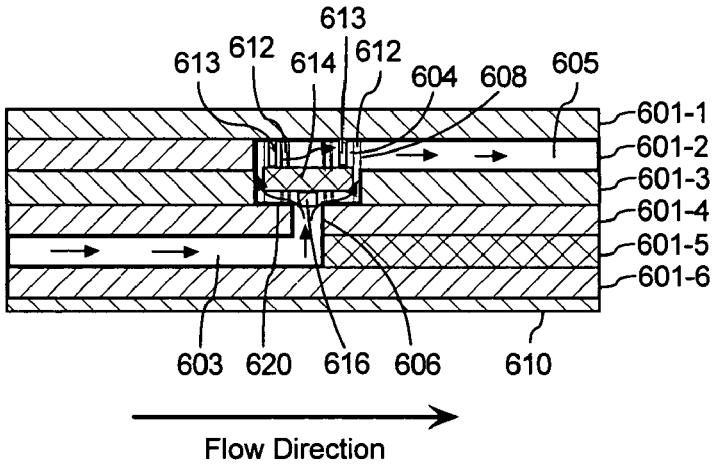
FIGS. 7A-7B are a set of drawings that are useful for understanding the operation of the micro-fluidic check-valve in FIG. 6.
Figure 7B:
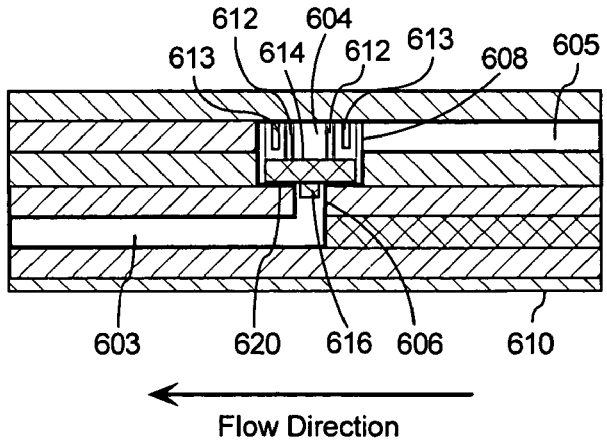
Figure 8:
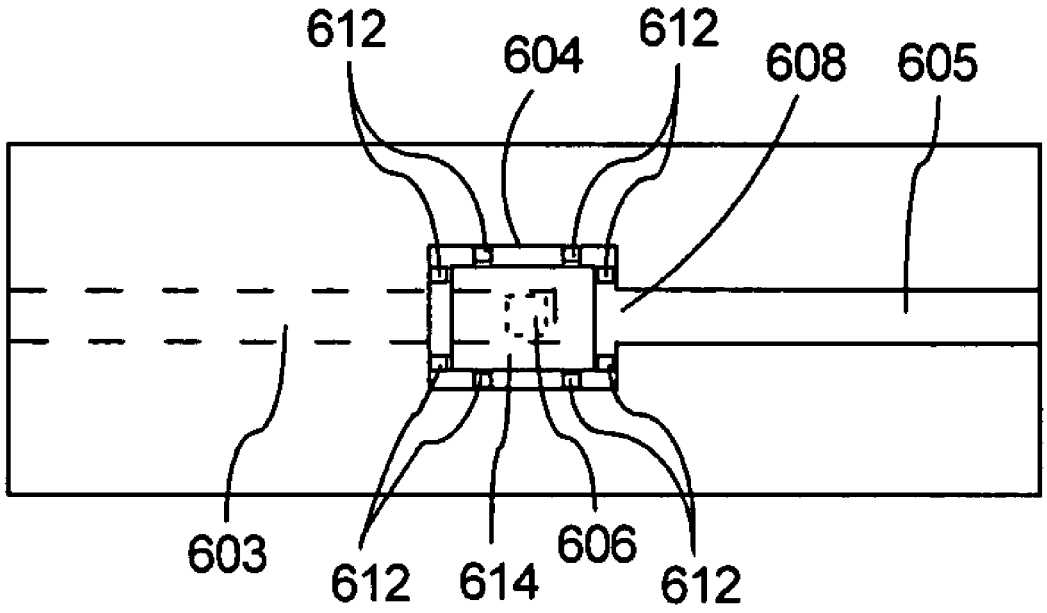
FIG. 8 is a cross-sectional view of the micro-fluidic check-valve in FIG. 6, taken along line 8-8.

FIGS. 6-8 show an alternative arrangement of a check-valve assembly 600 integrated in an LTCC substrate 602. As with the embodiment in FIGS. 1-5, the check-valve assembly 600 can be comprised of a plurality of unfired LTCC layers 601-1, 601-2, 601-3, 6014, 601-5, 601-6 and an optional conductive ground plane layer 610. More or fewer unfired LTCC layers can be used and the invention is not limited to any particular number of layers.

The unfired LTCC layers 601-1, 601-2, 601-3, 601-4, 601-5, 601-6 can define a check-valve chamber 604 that has at least one inlet port 606 and at least one outlet port 608. Input and output fluid conduits 603, 605 can be provided for fluid communication with the input and output ports respectively.

A plug 614 formed of fired LTCC or other material compatible with the LTCC firing process can be positioned within the check-valve chamber 604 during the lay up process of the unfired LTCC tape. For the purposes of the invention, a plug material is considered to be compatible with the LTCC firing process if it can survive such process without deformation, damage, or other changes that render the plug unsuitable for its intended purpose. The plug 614 is preferably formed so that it will be at least somewhat larger than the size of the opening defining the inlet port 606 after the LTCC tape layers forming the chamber have been fired.

The plug 614 can advantageously be formed so as to have any shape that will allow the plug to form a close fitting seal when it is urged against the inlet port 606. For example, a spherical or a parallelepiped shape can be used for this purpose. The spherical shape will allow the plug 614, when it is urged toward the inlet port 606, to block the inlet port 606 regardless of the orientation of the plug. The parallelepiped shape, if used to form the plug, can have a nub 616. The nub 616 can help center the plug in the inlet port and provide a better seal. Still, those skilled in the art will readily appreciate that the plug 616 can have other shapes and still form a suitable seal.

The inlet port 606 can also include a valve seat 620. The valve seat can define a contour or surface corresponding to at least a portion of the shape of the plug 614 for forming a good seal with the plug 614.

Referring again to FIGS. 7 and 8, a guide structure 612 can optionally be provided within the check-valve chamber 604 to constrain the motion of the plug 614. The guide structure 612 can perform several functions. For example, in those instances where a non-spherical shaped plug is used, the guide structure 612 can maintain the plug 614 in a desired orientation for forming a seal with the inlet port 606. The guide structure can also be used to limit a range of motion for the plug 614 so as to ensure that the plug cannot seal the outlet port 608 when fluid is flowing in a forward direction, i.e. from the inlet port toward to outlet port.

In FIGS. 7A-7B and FIG. 8, the guide structure 612 is formed as a series of ridges defined along the inner surface of the check-valve chamber 604. The ridges hold the plug in position while ensuring that flow of fluid can occur between the walls of the check-valve chamber and the outer periphery of the plug. Still, those skilled in the art will readily appreciate that the invention is not limited in this regard. Instead, any suitable structure can be defined within the check-valve chamber to limit the range of motion of the plug 614, provided that suitable accommodation is made to permit fluid flow in the flow direction shown in FIG. 7A.

Further, in order to facilitate operation of the check-valve in an inverted orientation, it can be advantageous to include spacers 613 disposed between the plug 614 and layer 601-1. As illustrated in FIGS. 7A and 7B, the spacers 613 can be formed as part of layer 601-1, 601-2 or as part of the plug 614. For example, the spacers 613 can be formed using conventional LTCC techniques that are well known in the art. The spacers can allow for fluid pressure to form above the plug when backpressure is applied.

The plug 614 can be formed in the required shape while the LTCC or other material from which it is formed is still in the unfired state. The plug 614 can then be fired prior to being positioned within the check-valve chamber 604. Alternatively, the plug 614 can be fired and then machined to the proper shape before being placed within the check valve chamber 604.

In either case, the plug 614 is advantageously fired prior to being positioned within the check-valve chamber. This pre-firing step ensures that the plug 614 will not adhere during the firing process to the surface of unfired LTCC tape layers 601-1, 601-2, 601-3, 601-4 comprising the check-valve chamber 604. Once the pre-fired plug 614 and the layers of unfired LTCC tape layers forming the check-valve chamber are assembled as shown, they are ready to be fired together to form a completed check-valve assembly.

As a further precaution to prevent adhesion of the plug 614 to the LTCC tape layers 601-1, 601-2, 601-3, 601-4 during a subsequent firing process, it can be advantageous to dispose a ceramic powder within the check-valve chamber on any surface within the chamber that will come in contact with the plug during the firing process. The ceramic powder can include the powders previously described in relation to FIGS. 1-5.

Referring now to FIGS. 7A, it may be observed that fluid flow in a forward direction can cause the plug 614 to disengage from the valve seat 620. The guide structure 612 and spacer 613 will ensure that the plug 614 can be guided so as to remain clear of the outlet port 608 as shown in FIG. 7A. Still, fluid will be able to flow freely in the forward direction since the ridges formed by the guide structure define fluid channels around the outer periphery of the plug 614.

The check-valve 600 can prevent a fluid backflow as shown in FIG. 7B. In the event that conditions in a fluid system in which the check-valve is installed cause a backpressure or fluid flow in the direction shown in FIG. 7B, the plug 614 will be urged toward the inlet port 606 and will ultimately become lodged in the valve seat 620. Thereafter, backflow of fluid will be prevented and the plug 614 will not become unseated until a fluid flow in the direction shown in FIG. 7A is resumed. Notably, if the check-valve arrangement in FIGS. 7A-7B and FIG. 8 is oriented as shown, gravitational force will urge the plug 614 toward the inlet port 606 provided that fluid is not flowing in the direction shown in FIG. 7A. Accordingly, the check-valve will remain in a normally closed position when fluid is not flowing in a forward direction. This can be an advantage in certain applications.

Figure 9:
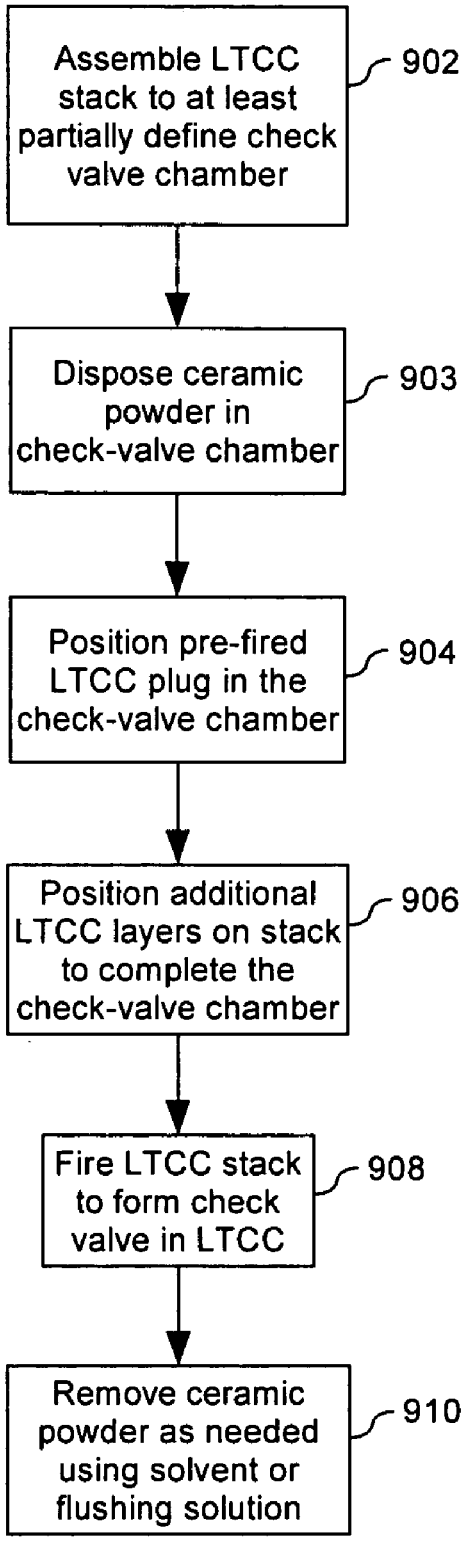
FIG. 9 is a flow chart that is useful for understanding a process for embedding a check valve in a micro-fluidic system.

Referring now to FIG. 9, a process for manufacturing a check-valve assembly as described herein shall now be described in greater detail. The process can begin in step 902 by forming an LTCC stack using conventional LTCC processing techniques. The stack can be comprised of a plurality of layers of Green Tape®, or any other similar type LTCC material, so as to at least partially define a check valve chamber 104, 604 as described herein. The stack can be comprised of a plurality of layers as described in relation to FIGS. 1-8. The exact shape, size and location of the check-valve chamber is not limited to a structure of any particular size, shape or location, provided that a plug positioned therein will block a flow of fluid in a backflow direction.

In step 904, a pre-fired plug 114, 614 can be disposed in the check-valve chamber as previously described. The plug can be formed of LTCC, aluminum oxide, zirconium oxide, or any other compatible material that can withstand the LTCC firing process without distortion or damage. In step 903, ceramic powder can optionally be added to the interior of the check-valve chamber 104, 604 prior to placement of the plug 114, 614 in order to help prevent adhesion of the plug to the walls of the chamber. Subsequently, in step 906, one or more additional LTCC layers can be added as necessary to complete the check-valve chamber. This stack of unfired LTCC tape layers and the fired LTCC plug contained therein completes the LTCC check-valve assembly. The assembly is ready for firing as part of a larger LTCC based fluidic system. Accordingly, the assembly can be fired in step 908. Thereafter, in step 910, any ceramic powder that has been disposed in the check-valve chamber can be removed using a suitable solvent or flushing agent.

One advantage of the foregoing process is that it allows the check-valve assembly to be integrally formed with the remainder of the fluidic system during the firing process.

The resulting system is compact, economical to manufacture, and offers the potential for good reliability. The use of a pre-fired plug and ceramic powder allows the assembly to be fired without adhesion of the plug to the interior walls of the check-valve chamber during subsequent firing steps.

After the check-valve assembly is formed, the LTCC stack can be fired in the conventional manner. LTCC initial firing temperature is typically up to about 500° C. to about 1100° C. depending on the particular design and LTCC material composition. The remaining processing steps for completing the part, including the placement and firing of one or more ceramic layers, and the addition of any electronic circuit component(s) to the surface of the device, can be performed in accordance with conventional LTCC fabrication techniques.

While the preferred embodiments of the invention have been illustrated and described, it will be clear that the invention is not so limited. Numerous modifications, changes, variations, substitutions and equivalents will occur to those skilled in the art without departing from the spirit and scope of the present invention as described in the claims.

We claim:

1. A method for embedding a check-valve in an LTCC based micro-fluidic system, comprising the steps of:

forming from at least one layer of an unfired low-temperature co-fired ceramic (LTCC) tape, a check-valve chamber, an inlet port in fluid communication with said check-valve chamber, and at least one outlet port in fluid communication with said check-valve chamber;

forming a plug from LTCC material;

pre-firing said plug;

subsequent to said pre-firing step, positioning said plug within said check-valve chamber; and subsequent to said positioning step, firing said at least one layer of said unfired LTCC tape together with said plug disposed in said check-valve chamber.

2. The method according to claim 1, further comprising the step of forming said plug from a material that can withstand said firing step without distortion or damage to said plug.

3. The method according to claim 1, further comprising the step of selecting a shape of said check-valve chamber and a position of said inlet port for automatically sealing said inlet port with said plug in the presence of a fluid backflow from said check-valve chamber toward said inlet port.

4. The method according to claim 3, further comprising the step of selecting said shape of said check-valve chamber for automatically unsealing said plug from said inlet port in the presence of a fluid flow from said inlet port toward said check-valve chamber.

5. The method according to claim 1, further comprising the step of forming said check-valve chamber with a plurality of said outlet ports.

6. The method according to claim 1, further comprising the step of selecting said plug to have a spherical shape.

7. The method according to claim 1, further comprising. the step of forming a valve seat for said inlet port, said valve seat defining a sealing surface corresponding to at least a portion of said plug.

8. The method according to claim 1, further comprising the step of forming said check-valve chamber exclusive of any structure to restrict the movement of the plug within the check-valve chamber.

9. The method according to claim 1, further comprising the step of constraining a range of movement of said plug to prevent sealing of at least one said outlet port.

10. The method according to claim 9, wherein said constraining step is further comprised of forming a guide structure in said LTCC tape for guiding said plug within said check-valve chamber.

11. The method according to claim 1, further comprising the step of disposing a ceramic powder within said check-valve chamber prior to said firing step.

12. The method according to claim 1, further comprising the step of forming said inlet port and said outlet port on mutually orthogonal surfaces of said check-valve chamber.

13. An embedded check-valve manufacturing assembly for integration in a micro-fluidic system, comprising:

a check-valve chamber formed from at least one layer of an unfired low-temperature co-fired ceramic (LTCC) tape, said check-valve chamber having an inlet port in fluid communication with said check-valve chamber and an outlet port in fluid communication with said check-valve chamber;

a plug positioned within said check-valve chamber and formed from fired LTCC; and wherein said plug and said at least one layer of said unfired LTCC tape forming said check-valve chamber can be fired together to form a completed check-valve assembly without adhesion of said plug to any portion of said check-valve chamber.

14. The embedded check-valve manufacturing assembly according to claim 13, wherein said check-valve chamber comprises a plurality of said outlet ports.

15. The embedded check-valve manufacturing assembly according to claim 13, wherein said plug has a spherical shape.

16. The embedded check-valve manufacturing assembly according to claim 15. further comprising a valve seat formed on said inlet port, said valve seat defining a sealing surface corresponding to at least a portion of said shape of said sphere.

17. The embedded check-valve manufacturing assembly according to claim 13, wherein said check-valve chamber provides an unrestricted range of movement for said plug within the check-valve chamber.

18. The embedded check-valve manufacturing assembly according to claim 13, wherein said check-valve chamber further comprises a guide surface formed of said LTCC tape for constraining the movement of said plug within said check-valve chamber.

19. The embedded check-valve manufacturing assembly according to claim 13, further comprising a ceramic powder disposed within said check-valve chamber.

20. The embedded check-valve manufacturing assembly according to claim 13 wherein said inlet port and said outlet port are disposed on mutually orthogonal surfaces of said check-valve chamber.

* * * * *